US009758288B2

(12) United States Patent
Bornstein

(10) Patent No.: US 9,758,288 B2
(45) Date of Patent: Sep. 12, 2017

(54) SYSTEM AND METHOD FOR ENCAPSULATING A COMIC BOOK

(71) Applicant: Michael Bornstein, Houston, TX (US)

(72) Inventor: Michael Bornstein, Houston, TX (US)

( * ) Notice: Subject to any disclaimer, the term of this patent is extended or adjusted under 35 U.S.C. 154(b) by 0 days.

(21) Appl. No.: 14/628,390

(22) Filed: Feb. 23, 2015

(65) Prior Publication Data

US 2016/0145027 A1 May 26, 2016

Related U.S. Application Data

(60) Provisional application No. 62/090,259, filed on Dec. 10, 2014, provisional application No. 62/082,914, filed on Nov. 21, 2014.

(51) Int. Cl.

| | |
|---|---|
| ***B65D 81/02*** | (2006.01) |
| ***B65B 7/16*** | (2006.01) |
| ***B65D 25/54*** | (2006.01) |
| ***G09F 3/20*** | (2006.01) |
| ***G09F 3/16*** | (2006.01) |
| ***B65D 85/00*** | (2006.01) |
| *B65D 81/24* | (2006.01) |

(52) U.S. Cl.

CPC ..... *B65D 81/02* (2013.01); *B65B 7/16* (2013.01); *B65D 25/54* (2013.01); *B65D 85/54* (2013.01); *G09F 3/16* (2013.01); *G09F 3/201* (2013.01); *B65D 81/24* (2013.01); *B65D 2101/00* (2013.01)

(58) Field of Classification Search

CPC .... B65D 2101/00; B65D 81/02; B65D 81/24; G09F 3/16; G09F 3/201

USPC ..... 206/232, 424, 450, 472; 40/611.13, 649, 40/661, 791, 792, 797

See application file for complete search history.

(56) References Cited

U.S. PATENT DOCUMENTS

| | | | | |
|---|---|---|---|---|
| 3,425,147 | A * | 2/1969 | Marx | A47F 11/02 40/757 |
| 3,665,628 | A * | 5/1972 | Dammond | G09F 1/12 40/790 |
| 4,282,667 | A * | 8/1981 | Glade | A47G 1/0611 40/611.05 |
| 5,186,566 | A * | 2/1993 | Cameron | G03B 21/64 206/449 |
| 5,219,524 | A * | 6/1993 | Evans, II | A47G 1/0616 162/160 |
| 5,353,925 | A * | 10/1994 | Lennen | B65D 81/266 206/1.7 |
| 5,625,969 | A * | 5/1997 | Vogler | G09F 15/0012 40/611.12 |
| 6,102,207 | A * | 8/2000 | Carse | B65D 11/10 206/1.5 |
| 6,149,003 | A * | 11/2000 | Day | A45C 11/182 150/150 |
| 6,308,831 | B1 * | 10/2001 | Saxe | B42F 7/14 206/38 |

(Continued)

*Primary Examiner* — Anthony Stashick
*Assistant Examiner* — Mollie Impink
(74) *Attorney, Agent, or Firm* — G. Michael Roebuck, PC

(57) ABSTRACT

A system and method for a comic book certification is disclosed. A comic book packaging system is disclosed providing with in inner seal enclose in a rectangular outer shell. End caps are provided on the outer shell. The end caps are applied on the outer shell on any of 4 sides. A label is provided under at least one of the clips. The inner well is made of polyester plastic, specifically PETG, polycarbonate, acrylic, uPVC.

9 Claims, 15 Drawing Sheets

(56) References Cited

U.S. PATENT DOCUMENTS

| | | | | |
|---|---|---|---|---|
| 2003/0014892 | A1* | 1/2003 | Matsuda | G09F 3/20 40/661 |
| 2008/0202947 | A1* | 8/2008 | Narzissenfeld | B42D 15/045 206/216 |
| 2012/0048773 | A1* | 3/2012 | Nozaki | B65D 81/02 206/560 |

* cited by examiner

SYSTEM AND METHOD FOR ENCAPSULATING A COMIC BOOK

CROSS REFERENCE TO RELATED APPLICATIONS

This patent application bases priority from US Provisional Patent Application entitled A System and Method for Encapsulating a Comic Book By Michael Bomstein Ser. No. 62/090,259 filed on Dec. 10, 2014 and US Provisional Patent Application entitled A System and Method for Encapsulating a Comic Book By Michael Bomstein Ser. No. 62/082,914 filed on Nov. 21, 2014, both of which are incorporated by reference herein in their entirety.

BACKGROUND OF THE INVENTION

Comic book collecting has rapidly grown from nothing more than a child's hobby to a substantial section of the collectables market. However, due to the size of comic books as compared to other types of collectibles such as baseball cards, storage and protection of comic books can cause problems for collectors. There is therefore a need for a comic book protection apparatus.

Additionally, collectors who wish to occasionally thumb through their comic books must remove the comic book from the enclosing protective device and then contact the pages with their fingers while thumbing through the comic book. This results in transfer of fingertip oils and prints to the surface of the comic book and the pages of the book, oils and prints which can mar or destroy the ink-printed drawings in the comic book. Most importantly, these oils and prints can damage or destroy the cover of the comic book, which most collectors consider to be the most important part of the collectable comic book. There is therefore a need for a comic book protection apparatus which will allow a collector to read the comic book without contacting substantial portions of the page surfaces. It is also important that a comic book protection apparatus be constructed of a flexible, substantially transparent material to enable viewing of the comic book when placed within the protection apparatus.

SUMMARY OF THE INVENTION

A comic book packaging system is disclosed providing an inner well enclosed in an outer shell. End caps are provided on the outer shell. The end caps are applied on the outer shell on any 2 opposing sides of the 4 sides. The end cap is made with a space so that the end cap breaks if pressure is applied to remove the end cap. A label is provided under at least one of the clips. The inner well is made of polyester plastic, specifically virgin PETG or un-recycled PETG, polycarbonate, acrylic, and uPVC. In another embodiment a front and back shell snap together to enclose a comic book.

BRIEF DESCRIPTION OF THE DRAWINGS

The Figures are provided to show examples of different embodiments of the invention.

DETAILED DESCRIPTION OF THE INVENTION

In a first embodiment, a comic book packaging system is disclosed in which a front and back plate forming an outer shell that encapsulates a comic book by snapping together to enclose the comic book. In another embodiment, a comic book packaging system is disclosed providing an inner well enclosed in a front and back plates. End caps are provided that snap onto and secured the joined front and back plates. The end caps are applied on the outer shell formed by the joined front and back plates on any 2 opposing sides of the 4 sides. The end cap is made with a structural space so that the end cap breaks if pressure is applied to remove the end cap. A label is provided under at least one of the end caps. The inner well is made of polyester plastic, specifically virgin PETG or un-recycled PETG. In another embodiment the inner well is made of materials including but not limited to polycarbonate, acrylic and uPVC.

Polyethylene terephthalate (aka. PET, PETE, and PETG) is a plastic resin of the polyester family that is used to make beverage, food and other liquid containers, as well as for some other thermoforming applications. PETG is a clear amorphous thermoplastic that can be injection molded or sheet extruded. It can be colored during processing. PETG can be semi-rigid to rigid, depending on its thickness, and it is very lightweight. The inventors have discovered that recycled PETG can be unsuitable for covering a comic book as the recycled PETG is subject to tearing and harming an encapsulated comic book. This discovery goes against the common belief that "PETG is that it is fully recyclable." Unlike other plastics, PETG has polymer chains can be recovered for additional use. It makes a good gas and fair moisture barrier, as well as a good barrier to alcohol and solvents. It is strong and impact-resistant. It is naturally colorless with a high transparency". See, e.g., http://www.lairdplastics.com/product/materials/petg Laird Plastics Brochure, contact Laird Corporate Headquarters, 6800 Broken Sound Pkwy; Suite 150, Boca Raton, Fla. 33487, PHONE: 561-443-9100, FAX:561-443-9108. PETG is recycled by taking excess PETG from molding jobs and melting the excess and processing the excess into a pellet or roll of recycled PETG. The inventor have discovered that only un-recycled PETG, also referred to herein as "virgin PETG" is of investment quality suitable for use in an embodiment of the present invention.

Figure 1:
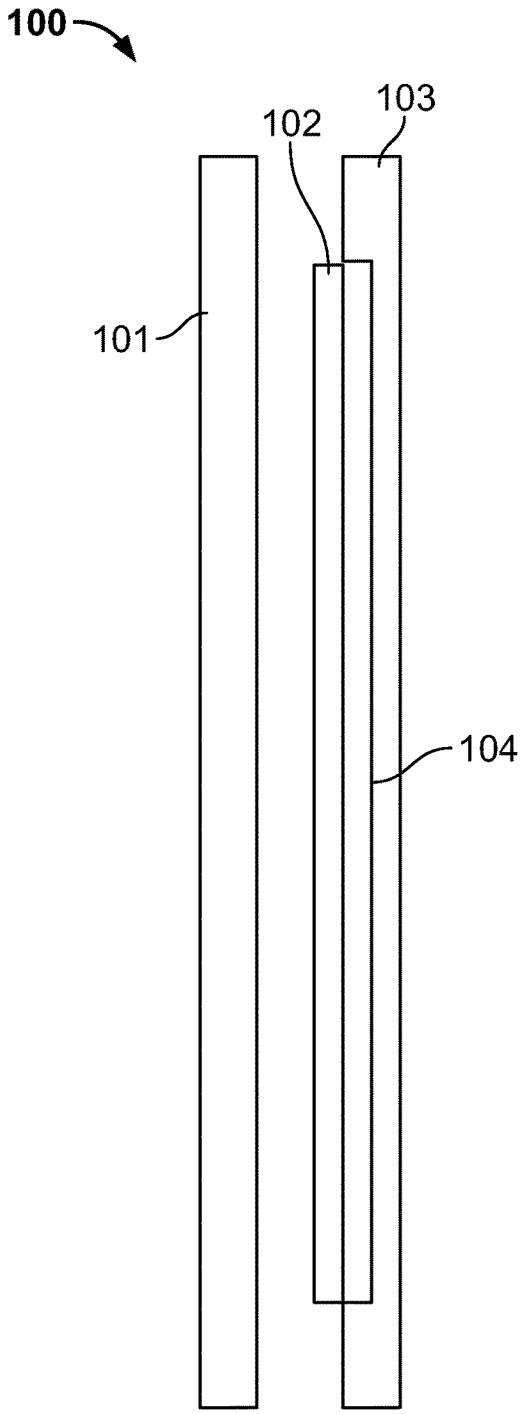
FIG. 1 is a schematic side view depiction of an illustrative embodiment of the invention.
Figure 2:
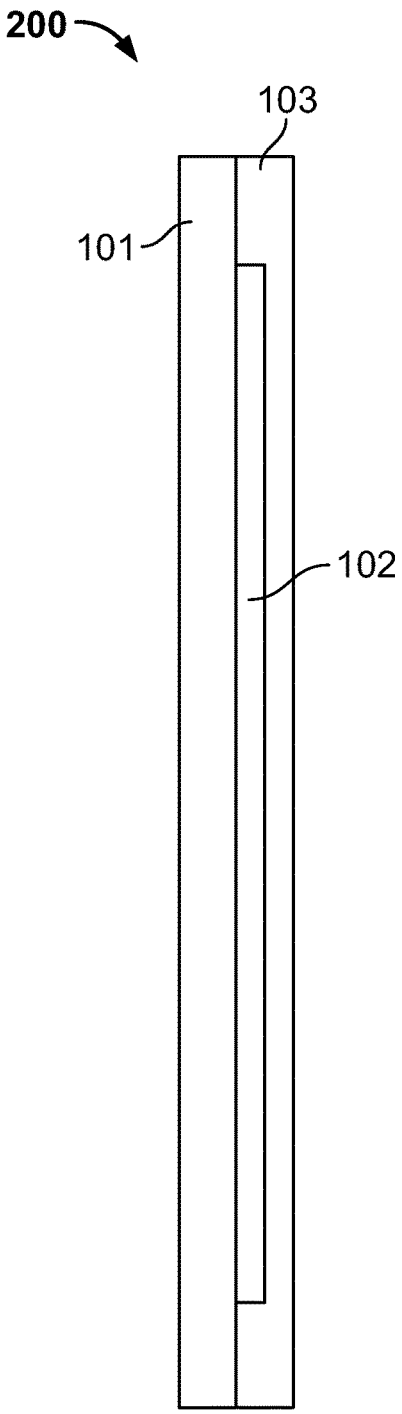
FIG. 2 is a schematic side view depiction of another illustrative embodiment of the invention.

Turning now to FIG. 1, a side view of a particular embodiment of the invention is depicted. As shown in FIG. 1, a front plate 101 (also referred to herein in the description and figures as the "comic book case top") and a back plate 103 (also referred to herein in the description and figures as the "comic book case bottom") are attached or joined together to enclose a comic book 102 as shown in FIG. 2. The front and back plates are joined and attached so that the front and back plates are attached together by fixing a surface on the front plate to a surface on the back plate. The front and back plates can be joined and attached together by any known means of fixing two planar surfaces together. The front and back plates can be joined, snapped together, glued together, pressed together or otherwise fixed to each other to encapsulate a comic book. As shown in FIG. 2, in another particular embodiment, the back plate 103 has a void 104 shaped to receive the comic book 102.

Figure 3:
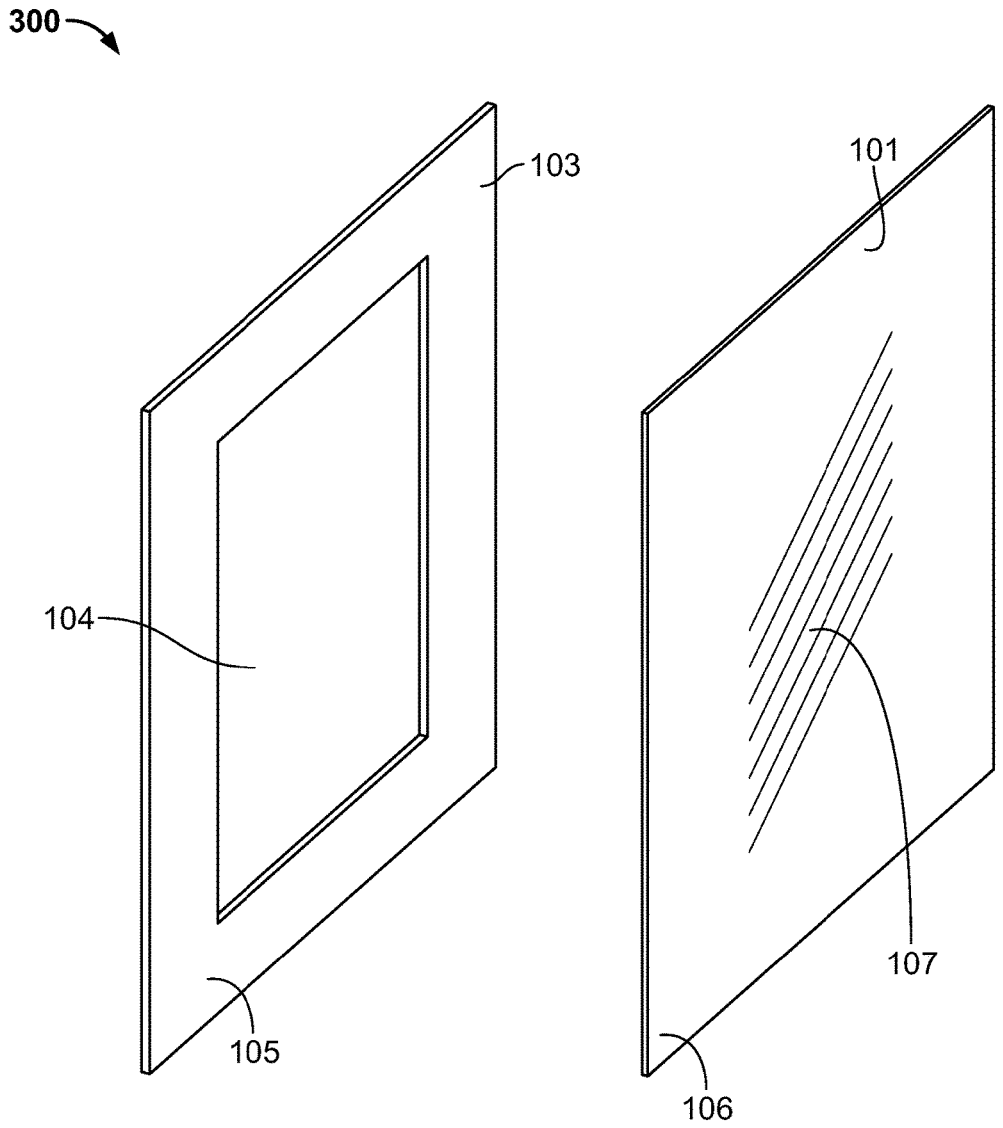
FIG. 3 is an orthographic projection schematic depiction of another illustrative embodiment of the invention.

Turning now to FIG. 3, in particular embodiment front plate 101 has an outer surface area 106 away from the center 107 of the front plate 101 surface area. Back plate 103 has an outer surface area 105 away from the center of the back plate surface area wherein is formed the void 104 for holding a comic book. In a particular embodiment, the outer surface area 105 of back plate 103 connects to the outer surface area 106 of front plate 101 to enclose a comic book in void 104. In a particular illustrative embodiment, outer surface area 105 connects to outer surface area 106 by an adhesive applied between the surface of outer surface area 105 and outer surface area 106 and the surfaces are pressed together to fix the outer surface areas 105 and 106 stick the surface together and enclose the comic book 102. In another particular embodiment, the outer surface area 105 and outer surface area 106 are pressed together to fuse the front and back plates together to enclose the comic book 102. In another particular embodiment, heat is applied as the outer surface area 105 and outer surface area 106 are pressed together to fuse the front and back plates together to enclose the comic book 102. In another an adhesive applied to one of the outer surface area 105 and outer surface area 106 and the surfaces are pressed together to fix the surfaces 105 and 106 together and enclose the comic book 102.

Figure 4:
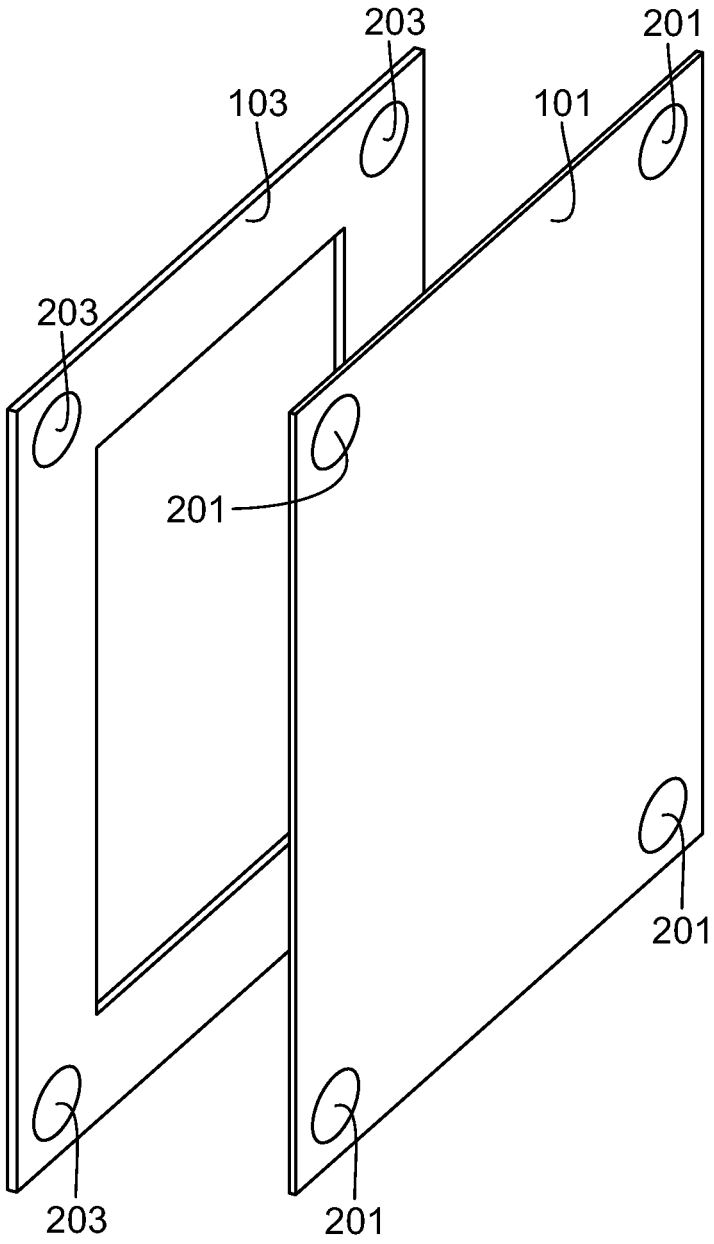
FIG. 4 is an orthographic projection schematic depiction of another illustrative embodiment of the invention.

Turning now to FIG. 4, in a particular embodiment the outer surface area 105 of back plate 103 connects to the outer surface area 106 of front plate 101 by at least one connecting apparatus 201 and 203. The connecting apparatus is a snap fitting that snaps together to fix the front and back plates the together. The connection apparatus 201 and 203 can also be glue, press fit, adhesive or any other means of fixing the front plate to the back plate. In a particular embodiment the connecting apparatus 201 is a receiver of connecting apparatus 203 in which connecting apparatus 201 mechanically receives connecting apparatus 203 and fixes the front plate and back plate together to enclose a comic book 102.

Figure 5:
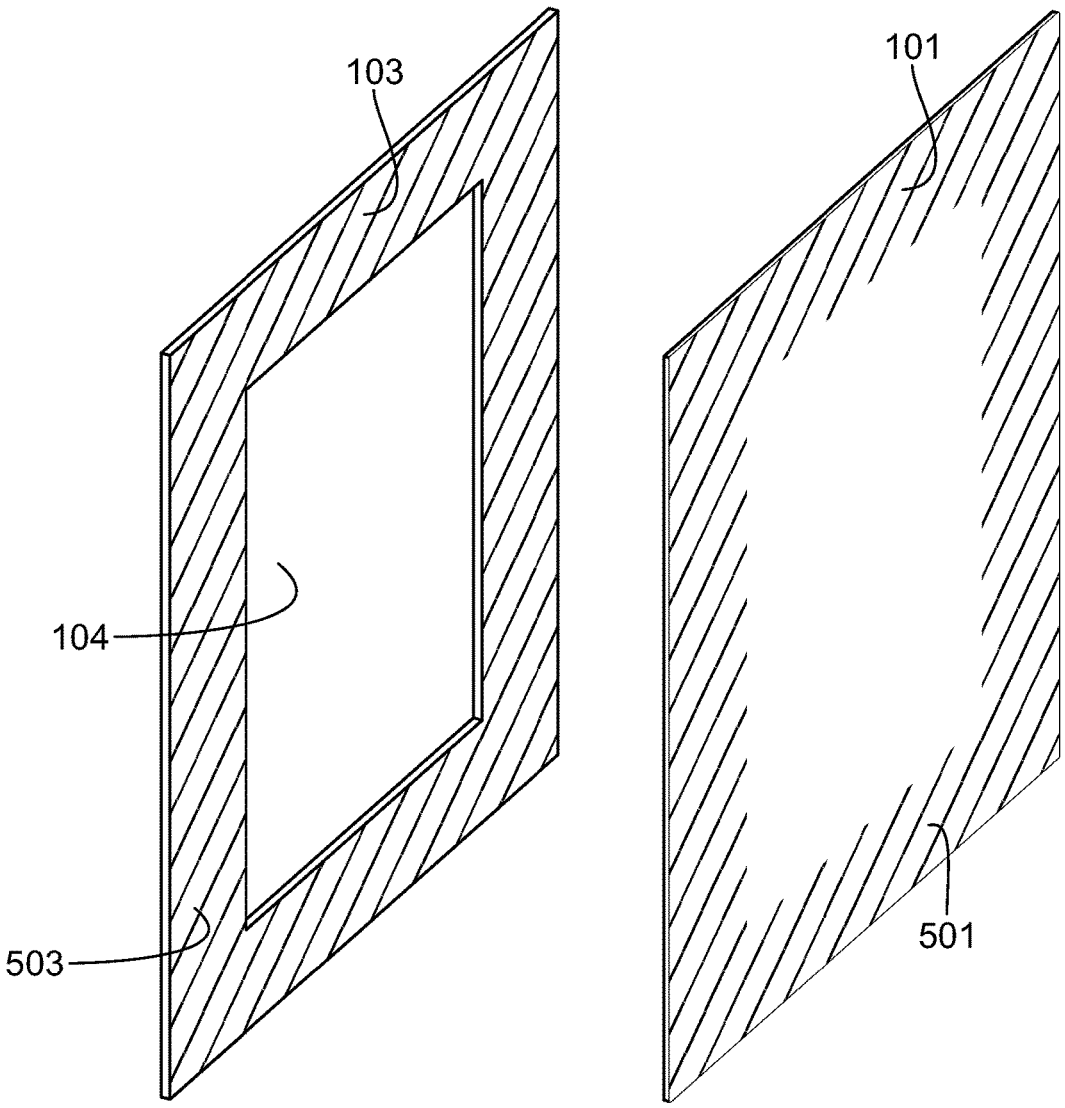
FIG. 5 is an orthographic projection schematic depiction of another illustrative embodiment of the invention.
Figure 6:
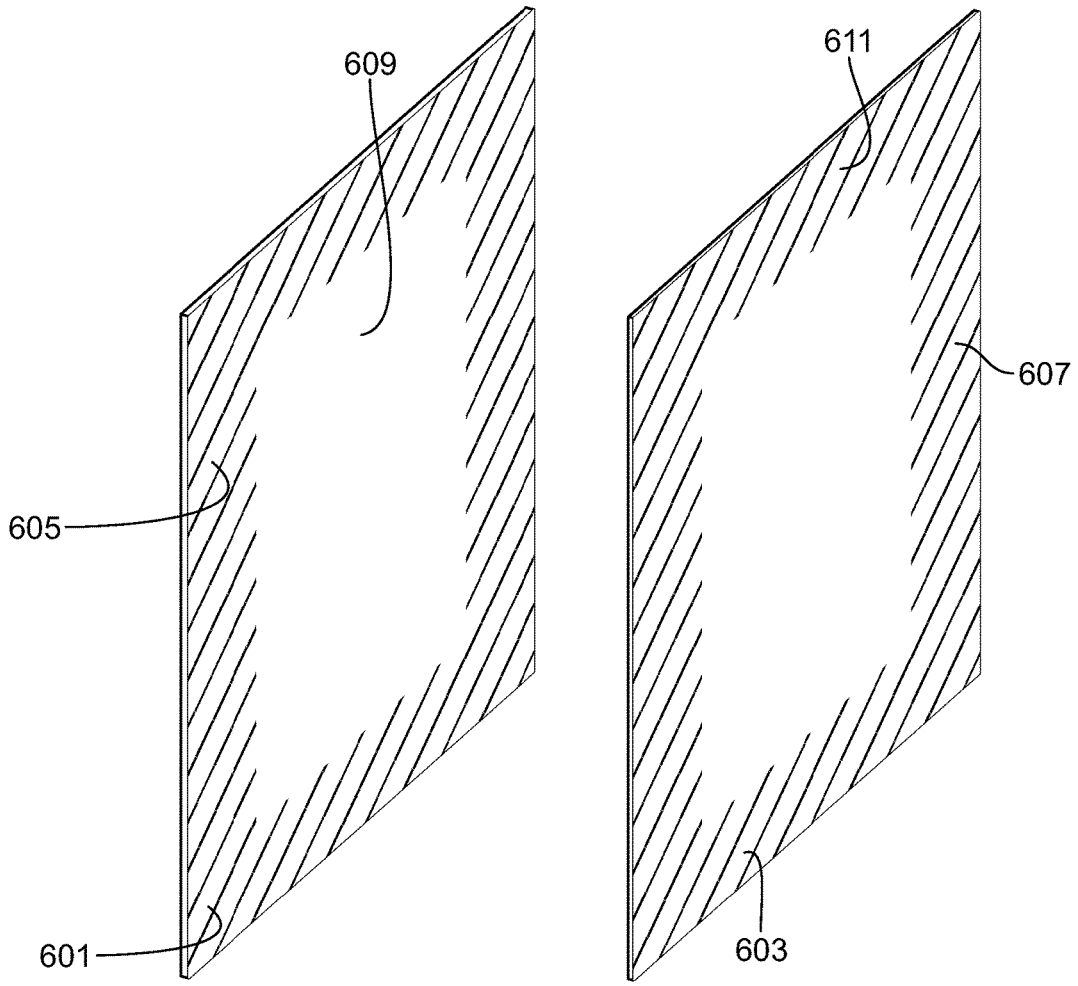
FIG. 6 is an orthographic projection schematic depiction of another illustrative embodiment of the invention.
Figure 7:
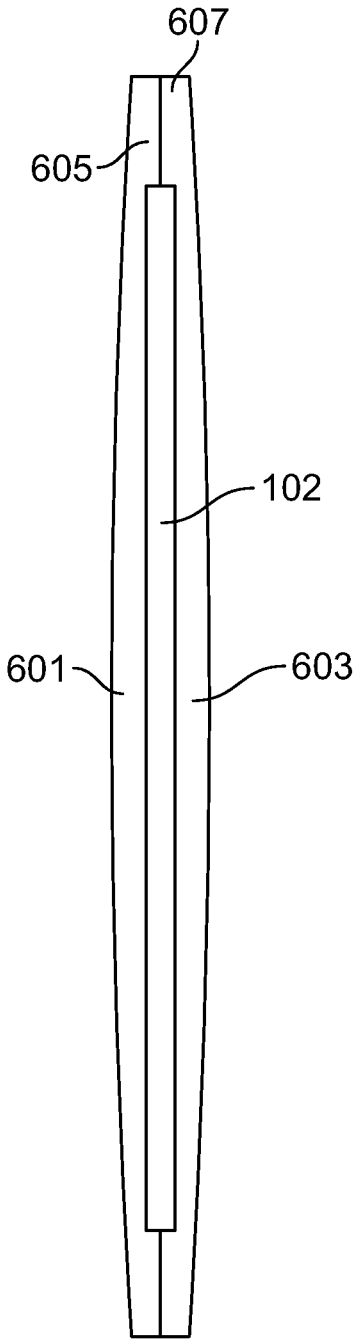
FIG. 7 is a side view schematic depiction of another illustrative embodiment of the invention.

Turning now to FIG. 5, in another embodiment of the invention, the outer surface area 105 and outer edge 106 shown in FIG. 5 are shown in additional detail as 503 and 501 respectively. Outer surface area 503 surrounds void 104. Turning now to FIG. 6, in another embodiment of the invention, outer surface area 105 and outer surface area 106 are shown in detail as ouster surface areas 605 and 607 respectively. The center surface area 607 of front plate 611 and center surface area 605 of back plate 609 are shown in detail. In the embodiment shown in FIG. 6, there is no void 104, the comic book fits between the front and back plates without the void 104 as shown in FIG. 7.

Figure 8:
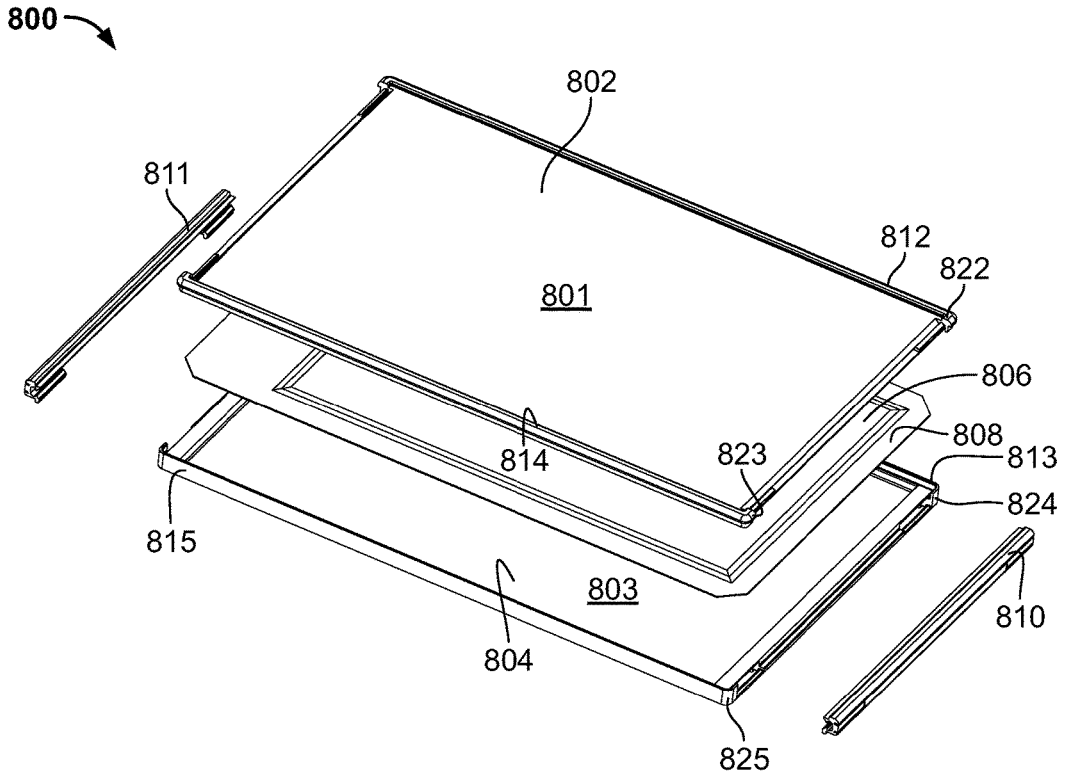
FIG. 8 is an exploded view schematic depiction of another illustrative embodiment of the invention.

Turning now to FIG. 8, another illustrative embodiment of the invention is schematically depicted. As shown in FIG. 8, a front plate 802 (also referred to herein as a "comic book case top") having a substantially transparent planar surface 801 and a back plate 804 (also referred to herein as a "comic book case bottom") having a substantially transparent planar surface 803 are fastened together to encapsulate comic book 806 and comic book covering inner well 808. The inner well has a substantially rectangular shape with flared corners as shown in FIG. 10. The front plate and back plate are fixed together with bottom end cap 811 and bottom end cap 810. The front plate 802 (also referred to herein and in the drawings as "top cover") has parallel top side ribs 812 and 814 terminate at each end of the front plate with a corner 822 and 823. The back plate 804 has parallel top and bottom side ribs, upper ribs 814 and bottom ribs 815 that terminate at each end of the front and back plates with a corner 824 and 825. The upper rib 814 fits into the bottom rib 815 when the front and back plates are joined together as shown and described herein. The front plate and back plates fit together to enclose the comic book and form an end cap mating receptacle, in this case a male receptacle, at each end onto which the end caps fit. The end caps 810 and 811 fit onto the end cap mating receptacle formed by the joining of front plate between adjoining corner pairs 822/824 and 823/825 and hold front and back plates in place as shown in FIG. 8 and FIG. 9.

Figure 9A:
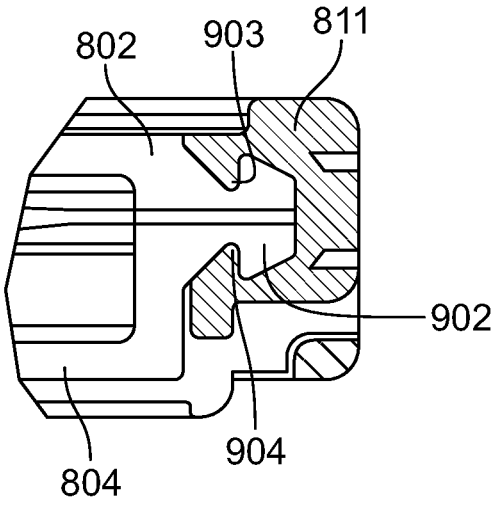
FIGS. 9A and 9B are a cross sectional schematic depiction of another illustrative embodiment of the invention.
Figure 9B:
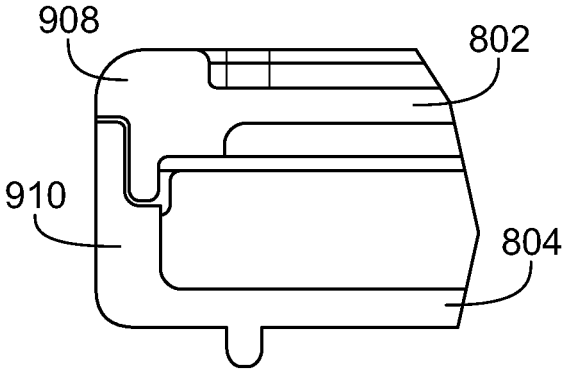
Figure 10:
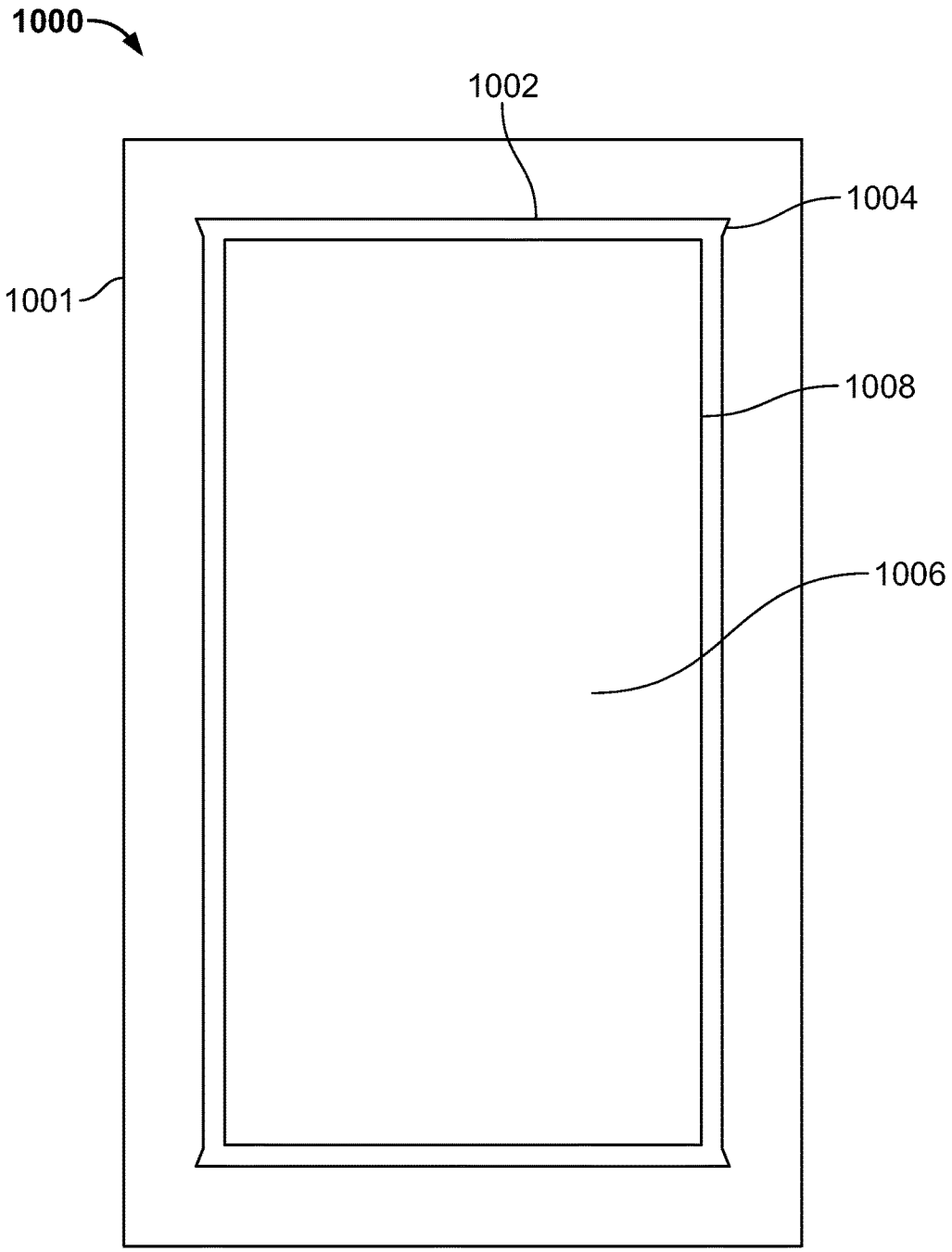
FIG. 10 is a front view of an illustrative embodiment of the invention.
Figure 11:
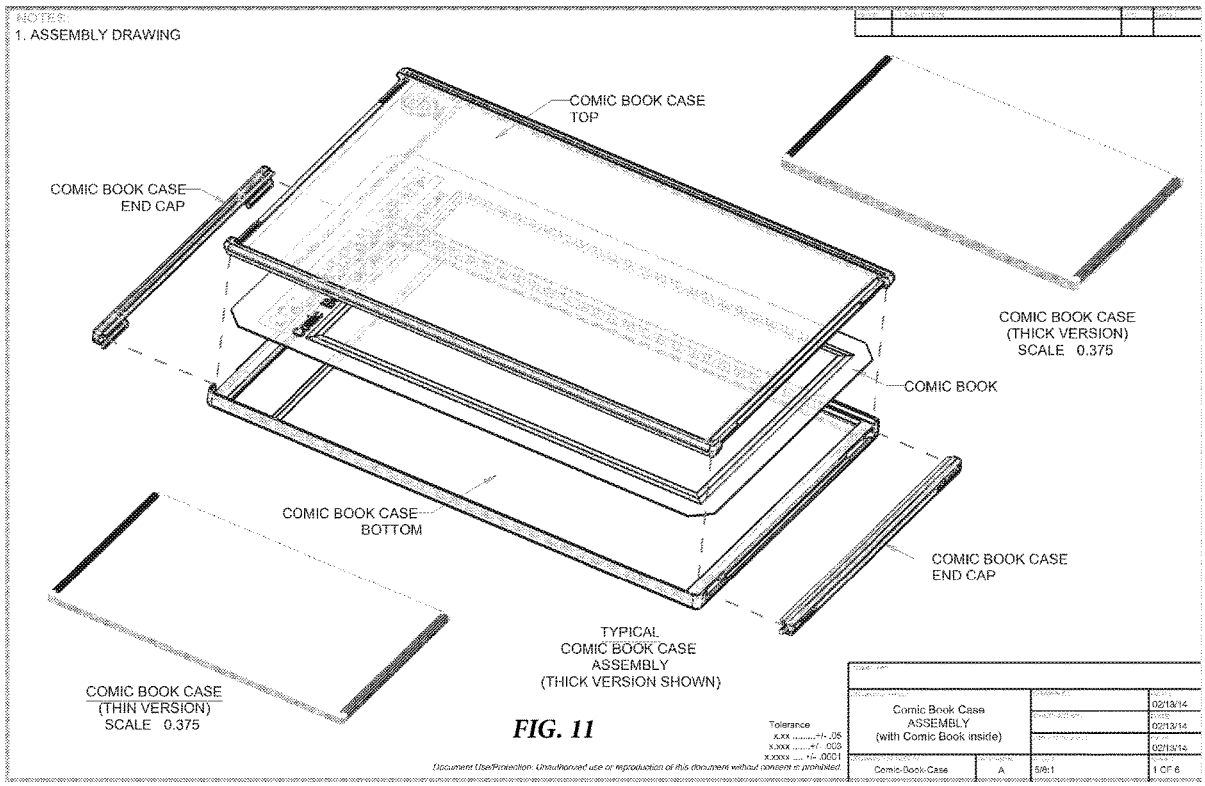
FIGS. 11-16 are views of illustrative embodiments of the invention.
Figure 12:
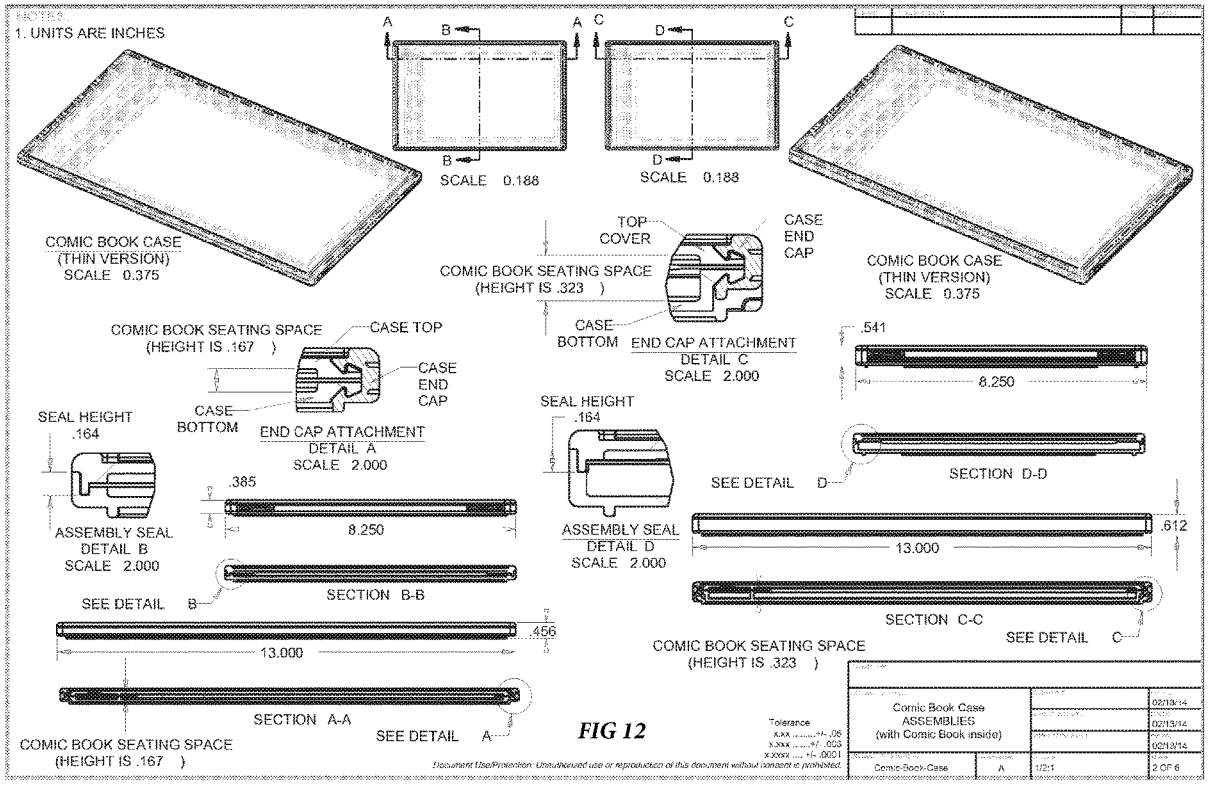
Figure 13:
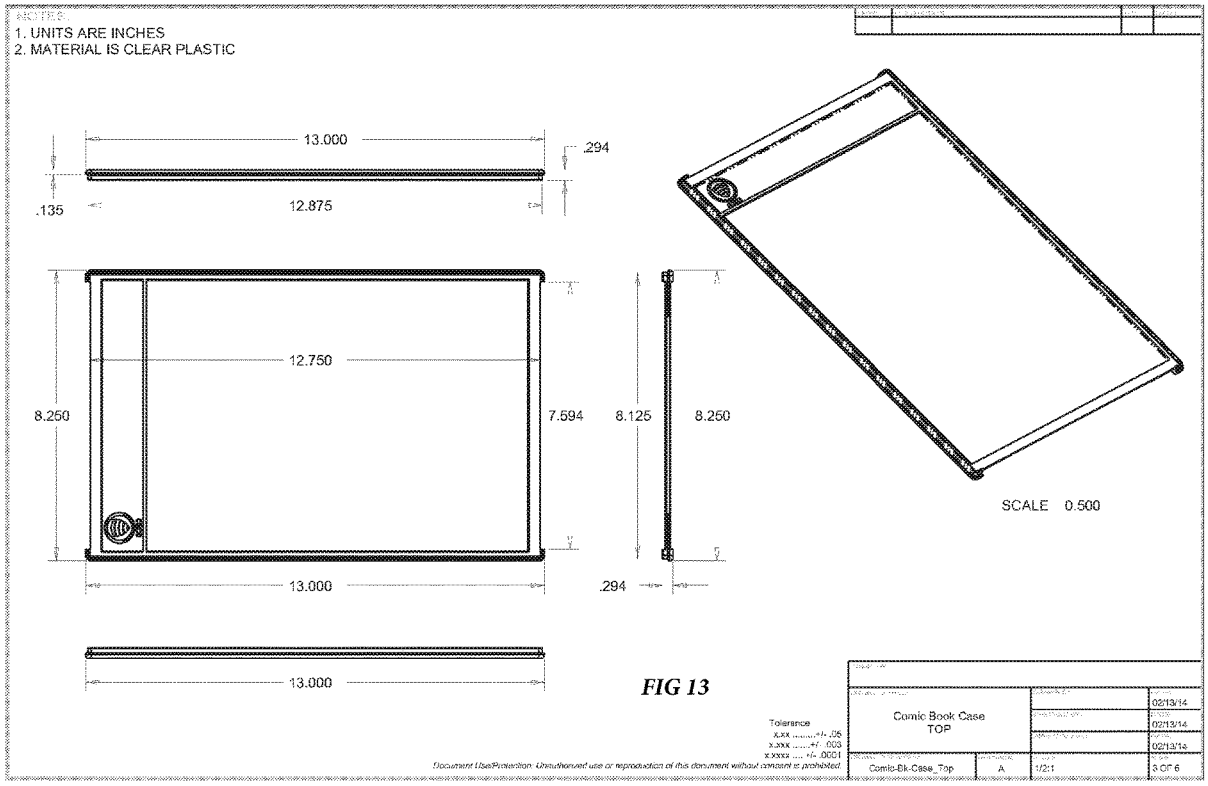
Figure 14:
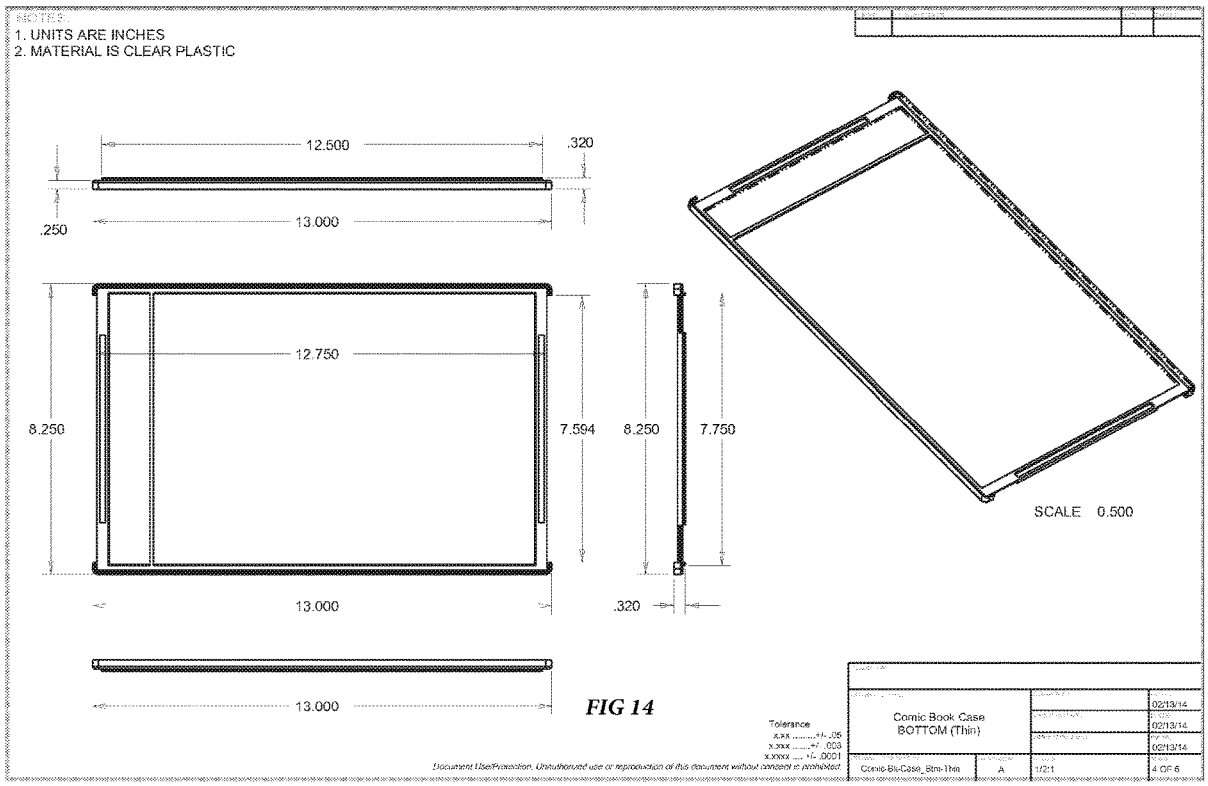
Figure 15:
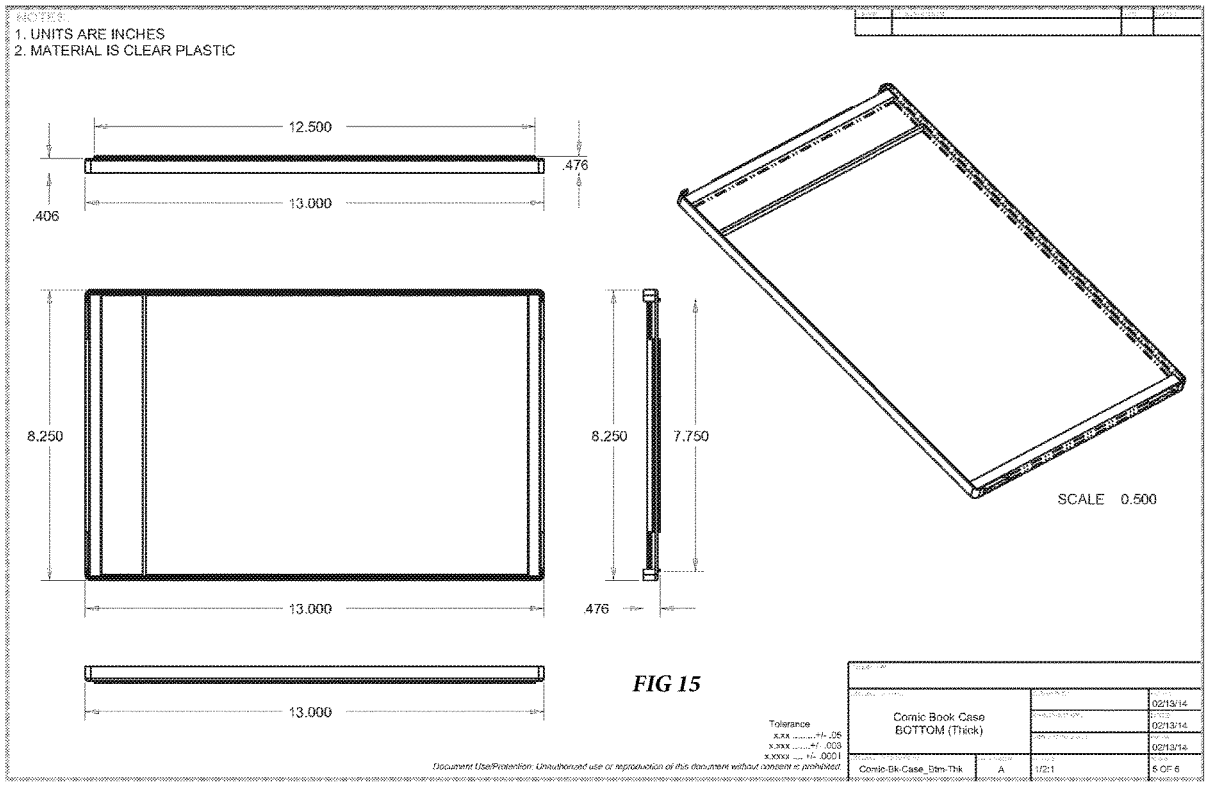
Figure 16:
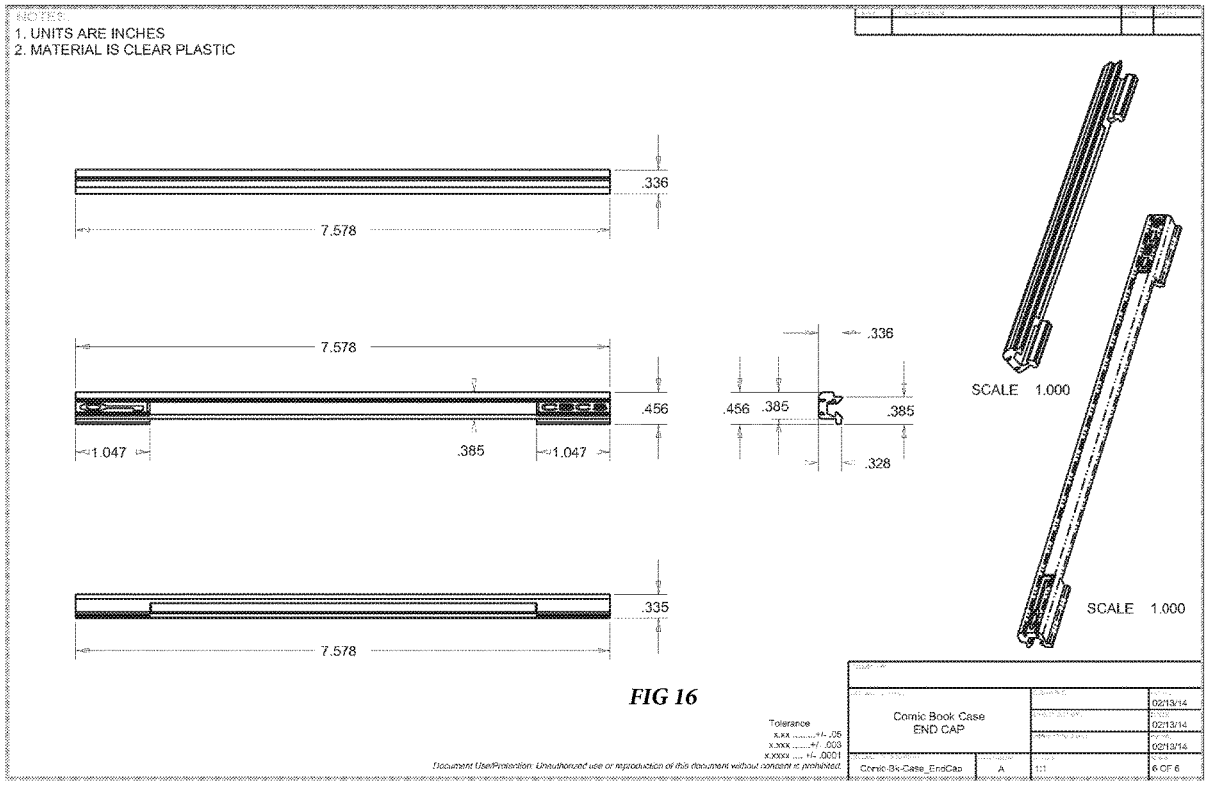

Turning now to FIG. 9, a cross section of the end cap 811 is depicted. As shown in FIG. 9, the cross section shows that end cap 811 has an upper tooth 903 and lower tooth 904 that snap onto grooves 905 and 906 formed on the upper and lower plate respectively, to make an end cap mating receptacle formed by the joining of the front and back plates between adjoining corner pairs 822/824 and 823/825 and holds front and back plates in place as shown in FIG. 8 and FIG 9. In one embodiment, the end caps 810 and 811 are made of a softer material than the front and back plates, so that one of the end caps cannot be removed once it is snapped onto the joined front and back plates, unless softer end cap is broken, thereby indicating that the comic book enclosure has been broken into, thereby possible jeopardizing the integrity of any certifications for the comic book before the comic was sealed in the enclosure. In another particular embodiment, a hinge 920 connect the top and bottom plates so that they are hinged at the top and the end cap is only snapped onto the case at the bottom.

Top side ribs 812 and 814 run along the sides of top plate 802. The side ribs are thicker than the top plate and protrude above the plane 801 of the top plate that is parallel to the face of the comic book 806. Each top side rib 812 and 814 terminates into an end cap stop 822 and 823. The end cap fits onto the top and back plates between the end cap stops. The bottom side ribs 813 and 815 are thicker than the bottom plate and protrude above the plane 803 of the bottom plate that is parallel to the face of the comic book 806. Each top side rib 812 and 814 terminates into an end cap stops 824 and 825. The end cap slides over the ends of the joined front and back plate and snaps onto the joined front and back plates to join the front and back plates together. The ends of the front and back plate join together with a snap fit connection formed by the joining of top and bottom plates forming a channel in between the paired end cap stops 822/824 and 823/825. The end caps are snapped onto the joined front and back plates and cannot be removed by sliding the end cap longitudinally off to either side as the end cap stops prevent longitudinal sliding of the end caps. Thus, the end cap is snapped onto the joined front and back plates and fixed so it cannot be removed without breaking the end cap.

The front plate and back plates upper and lower ribs form overlapping ridges 908 and 910. The upper ridges 908 is formed on each of upper ribs 810 and 814. Ribs 908 overlap ridge 910 formed on bottom ribs 813 and 815. Ribs 908 and 910 fit together and overlap along the sides of front plate and back plates. In a particular embodiment, the sides of the top plate forms inner ridge 908 that fits inside outer ridge 910 formed on sides of back plate 804. The overlapping ridges 908 and 910 helps to increase the difficulty of a comic book being removed from the case after the front and back plates are secured with the end caps at the top and bottom of the case encapsulating the comic book.

Turning now to FIG. 10, in a particular illustrative embodiment 1000, an inner well 1001 is depicted. The inner well 1001 provides a cavity 1002 for receiving an item with 90 degree corners such as a comic book 1006. The cavity in the inner well has a substantially rectangular shape with flared corners 1004. The flared corners help remove the comic book from the inner well without damaging the comic, as shown in FIG. 10. In a particular illustrative embodiment, the inner well provides a top and bottom portion that seals the comic book. The comic book is sealed in the inner well and encapsulated in the case formed by joining the top and bottom plates.

FIGS. 11-16 are views of illustrative embodiment of the invention. The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A comic book case for encapsulating a comic book, the case comprising:

a substantially transparent front plate and a substantially transparent back plate, wherein the front and back plates are substantially together on two edges into each other;

an inner well having a recess containing the comic book, wherein the front and back plates engagingly fit into each other and encapsulate the inner well and comic book between the front and back plates;

an end cap that snaps onto and holds together adjacent edges of the engaged front and rear plates; and a pair of end cap stops formed on the corners of the adjacent edges of the front and rear plates, wherein the end cap snaps onto the adjacent edges of the front and rear plates between the end cap stops, wherein the end cap stops prevent longitudinal sliding of the end cap off of the front and rear plates.

2. The case of claim 1, wherein the end cap stops prevent longitudinal sliding of the end cap off of the front and rear plates.

3. The case of claim 1, wherein the inner well containing the comic book fits between the front and rear plate is made of un-recycled PETG.

4. The case of claim 2 wherein the top and bottom plates are made of a material softer than the end cap so that the end cap damages the top and bottom plates if removed from the case providing an indicia of tampering with the case.

5. The case of claim 2, wherein the end cap is made of polycarbonate.

6. The case of claim 1 the front and back plate further comprising: ridges on two sides of the front and back plate on the sides not engaged by the end cap, wherein the ridges overlap each other when the front and back plates are joined to prevent sliding the inner well from the case through a side of the case while the end cap is engaged with the front and rear plates.

7. The case of claim 1, wherein the end cap is made of polystyrene.

8. The case of claim 1, the case further comprising:

a tooth on the end cap; and a groove on at least one of the front and rear plates, wherein the locking tooth on the end cap stretches when pressure is applied and snaps into the groove to substantially prevent removal of the end cap from the front and rear plates.

9. The case of claim 1, the inner well further comprising:

a front cover and a back cover; and a cavity formed in the back cover having a substantially rectangular shape with flared corners for containing the comic book.

* * * * *